United States Patent [19]

Bruhn et al.

[11] 4,017,345

[45] Apr. 12, 1977

[54] PROCESS FOR PRODUCING PILE FABRICS AND AN APPARATUS FOR CARRYING OUT THE PROCESS

[75] Inventors: Esben Bruhn, Horning; Finn Hansen Jensen, Skanderborg, both of Denmark

[73] Assignee: A/S Weston Toeppefabrik, Horning, Denmark

[22] Filed: Oct. 31, 1975

[21] Appl. No.: 627,862

[30] Foreign Application Priority Data

June 4, 1975 Denmark ..... 2497/75

[52] U.S. Cl. ..... 156/72; 156/259; 156/271; 156/435

[51] Int. Cl.[2] ..... B32B 31/18; B32B 31/22

[58] Field of Search ..... 156/72, 68, 435, 259, 156/271, 510, 512

[56] References Cited

UNITED STATES PATENTS

| | | | |
|---|---|---|---|
| 279,922 | 6/1883 | Crapon | 156/72 |
| 3,477,889 | 11/1969 | Partensky | 156/72 |
| 3,493,452 | 2/1970 | Cole | 156/271 |
| 3,769,130 | 10/1973 | Jones et al. | 156/259 |
| 3,843,432 | 10/1974 | Wetherington | 156/72 |

*Primary Examiner*—Charles E. Van Horn
*Assistant Examiner*—John E. Kittle
*Attorney, Agent, or Firm*—Watson, Cole, Grindle & Watson

[57] ABSTRACT

To produce a pile fabric, particularly a pile carpet, a fibrous batt, in which the fibres are transversely oriented, is cut into longitudinal strips which are then turned through an angle of 90° about their longitudinal axes by means of pairs of conveying wires, which run in paths from oppositely located guiding grooves of a pair of input rollers to guiding grooves located side by side in the surface of a depositing roller by means of which the fibres, which are now standing on end, are applied to an adhesive backing.

17 Claims, 13 Drawing Figures

PROCESS FOR PRODUCING PILE FABRICS AND AN APPARATUS FOR CARRYING OUT THE PROCESS

BACKGROUND OF THE INVENTION

This invention relates to a process for the production of pile fabrics, particularly carpets.

Processes for this purpose have been proposed in which an elongated batt of fibrous material oriented substantially transversely of the longitudinal direction of the batt is cut into longitudinally extending strips, whereafter these are individually turned through an angle of 90° about their longitudinal axes so that the small lengths of fibres formed in the cutting operation now stand on end in pile fashion in the combined structure constituted by the totality of strips when these are advanced side by side. For causing the rotation of the strips it has been proposed to use belts having a width substantially corresponding to the length of the pile fibres and to move these belts with the fibrous strips held therebetween through turning blocks having a twisted passage opening. In a further step the fibres are removed from between these belts and the strips are merged to form a continuous batt in which the pile fibres are standing on end, and in this form the fibrous material is then advanced to a station where they are joined with a backing having an adhesive surface.

SUMMARY OF THE INVENTION

It is an object of the invention to provide an improved process for the production of pile fabrics, in which the pile is likewise formed by cutting a batt of fibrous material into strips and individually turning these strips through an angle of 90° about their longitudinal axes to make the cut fibres stand on end in pile fashion, but where the cut fibres are kept directly under control by the same conveying means right from the time of their formation till the moment where they are deposited on the adhesive surface of a backing.

It is a further object of the invention to provide a simple process by which pile fabrics of a high degree of uniformity and perfection can be produced at a high rate of production.

According to the invention, a process for producing pile fabrics comprises the steps of providing a batt having substantially parallel edges defining a longitudinal direction of the batt and consisting of a fibrous material oriented substantially transversely of said longitudinal direction, forwarding said batt in its longitudinal direction, subdividing said batt into strips by cuts longitudinal of the batt and substantially perpendicular to the orientation of the fibres, forwarding each strip in a free path between a pair of conveying wires running from a position, in which they are located in positions opposite one another on either side of the subdivided batt to a position in which they are located side by side in a longitudinal plane of the subdivided batt, thereby turning each strip through an angle of 90° about its longitudinal axis, and depositing the strips in the form of fibres on end from between said pairs of conveying wires onto an adhesive surface of a backing.

Thus, according to the invention, a pair of wires, preferably running in straight paths under tension from a pair of input rollers to a single depositing roller, is used as the sole means of turning each of the strips cut from the fibrous batt and then carrying them forward to the zone of application to the adhesive backing. The pile fibres are therefore under control during the whole of their travel and are consequently deposited with great regularity.

For carrying out the process the invention also relates to an apparatus comprising, as its main features, a pair of input rollers which by means of opposed grooves in the rollers of the pair is subdivided into a number of sections means for introducing a batt of fibrous material oriented substantially in the axial direction of said input rollers into a nip zone of said pair of input rollers, cutting means being provided between said sections for cutting the fibre batt introduced between the rollers into strips, viz. one strip for each section, opposed wire guiding grooves for a pair of conveying wires being provided in each section in the circumferential surfaces of the two rollers of the pair, a depositing roller being provided at a distance from said pair of input rollers, said depositing roller having a number of pairs of circumferential guiding grooves corresponding to the number of sections of the pair of input rollers, the circumferential guiding grooves of each pair being located side by side, each of said pair of conveying wires running in paths from a pair of guiding grooves of the pair of input rollers to a corresponding pair of guiding grooves of the depositing roller and from there onwards across guiding rollers back to the respective input rollers, and means for moving an adhesive backing past said depositing roller in a path to receive the fibres on end of the strips conveyed by said conveying wires as these proceed to a zone of closest approximation of said depositing roller and said backing.

DESCRIPTION OF THE PREFERRED EMBODIMENT

Figure 3:
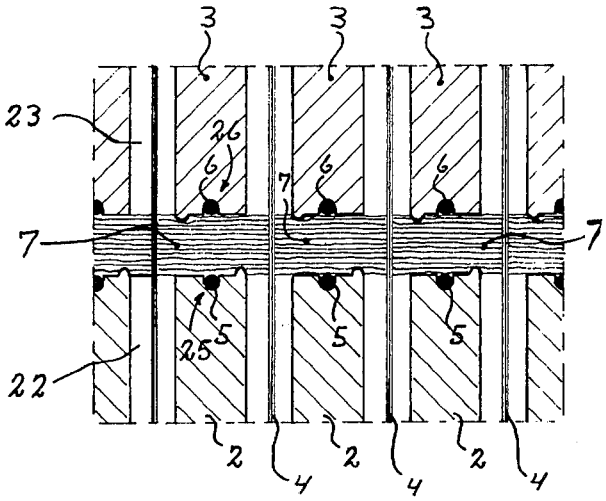

The apparatus illustrated in the drawing has a pair of input rollers 2 and 3 which by means of opposed grooves 22 and 23, FIG. 3, in the two rollers are subdivided into a number of sections between which cutting means are provided in the form of rotating knives 4 serving to cut a fibrous batt 1 introduced between the rollers into strips, viz. one strip for each section. In each section the two rollers 2 and 3 are constructed with opposed wire guiding grooves 25 and 26 respectively, FIG. 3, for a pair of conveying wires 5 and 6. These conveying wires 5 and 6 run from the input rollers 2 and 3 in straight paths to wire guiding grooves 35 and 36 respectively, FIG. 7, located side by side in the circumferential surface of a depositing roller 10 and proceed to a guiding and driving roller 15 which is likewise provided with pairs of wire guiding grooves located side by side. One set of conveying wires 6 comprising one wire of each pair proceeds directly back to the input roller 3, while the other set of conveying wires 5 is returned through the spaces between the paths of the conveying wires from the input rollers 2 and 3 to the depositing roller 10, preferably in a point of that path where the turning of the strips about their longitudinal axes caused by the conveying wires has proceeded to an advanced stage, and then across a guiding roller 30 back to the input roller 2.

The knives 4 rotate about an axis 40 outside the contour of the input rollers and extend into the grooves 22 and 23 between the sections of the input rollers 2 and 3, the cutting edges of the knives preferably passing substantially through the nip zone of the pair of input rollers.

Figure 1:
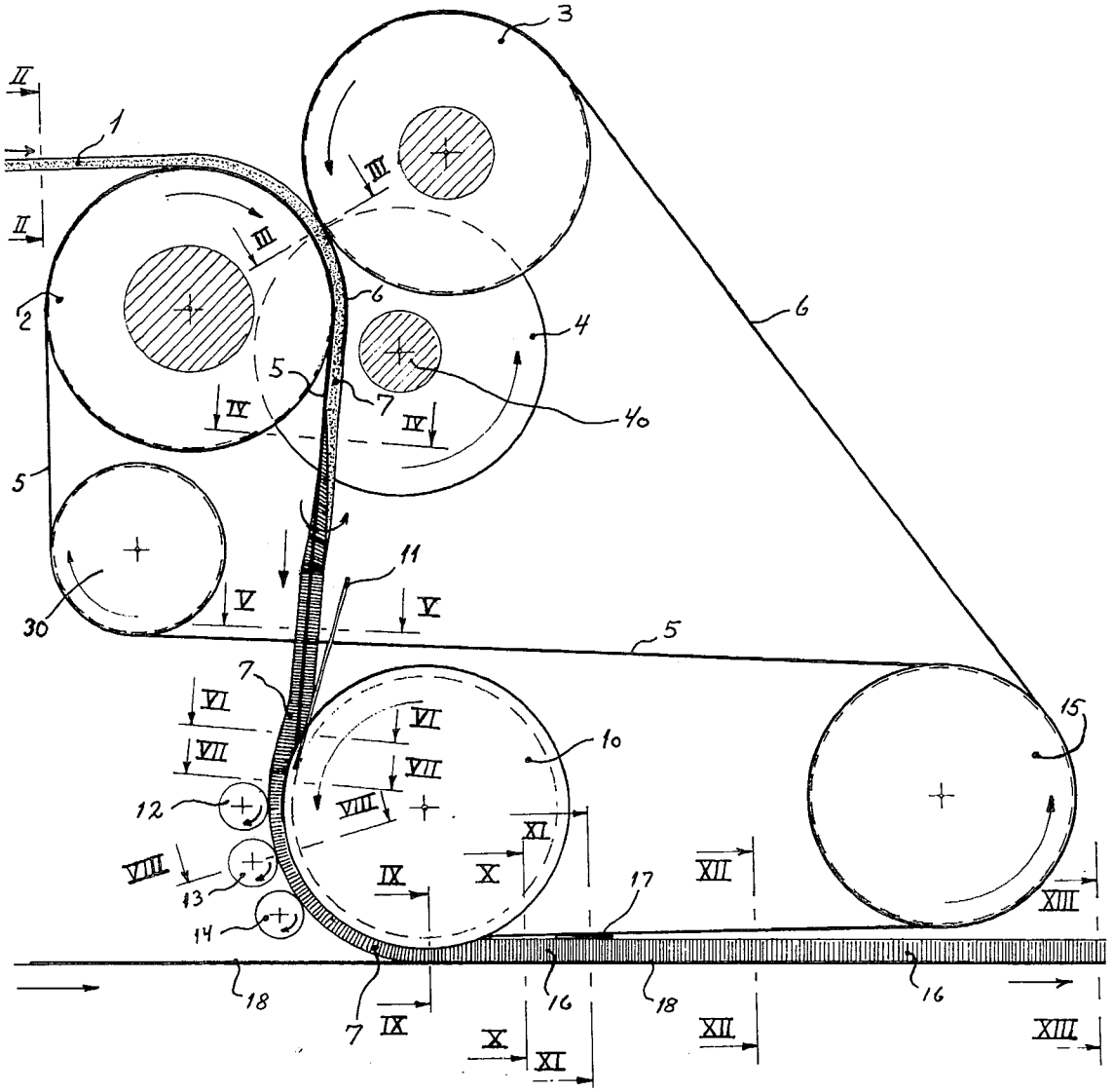
FIG. 1 is a diagrammatic side view of the essential parts of an apparatus according to one embodiment of the invention.
Figure 2:
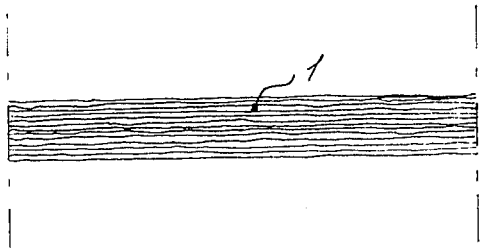
FIGS. 2–13 are sections along the lines in FIG. 1 denoted by the corresponding Roman numerals.

For carrying out the process a starting material 1, FIG. 2, is required consisting of a uniformly distributed layer of fibres, threads or yarns oriented perpendicularly or substantially perpendicularly to the direction of production, or in other words transversely to the marginal edges of the layer. This layer or batt 1 may be a product made in advance or it may be made in situ. The thickness of the fibrous layer 1 determines the tightness of the pile in the final product and may be varied up to a maximum value depending on the dimensions of the parts of the apparatus. The fibrous batt or layer 1 is introduced between the two input rollers 2 and 3. The manner in which the fibrous layer 1 is produced and introduced between the input rollers 2 and 3 does not form part of the invention, but may be carried out in accordance with well known principles. E.g. production and advancing of the fibrous layer may take place by means of two spiked chains which run across sprockets at the ends of the roller 2 and across which a fibrous layer is placed in a compact zigzag path so as to be held by the spikes. At the ends of the input roller 2 there may then be mounted rotating knives for the clean cutting of the edges of the fibrous layer. During the passage of the fibrous layer 1 towards the input roller 2 it may be supported by a supporting surface (not shown) or the conveying wires may before reaching the input roller 2 be passed around a further guiding roller (not shown) in level with the underside of the fibrous layer.

When the fibrous layer reaches the nip zone of the input rollers 2 and 3, it is cut into strips by means of the knives 4 which may also be replaced by other cutting means such as water jets. In the nip zone itself where the cutting takes place the conveying wires 5 and 6 have no function, see FIG. 3. The function of the input rollers 2 and 3 is to hold and advance the fibrous layer 1 during the cutting operation. The distance between the knives 4 defines the height of the pile.

Figure 4:
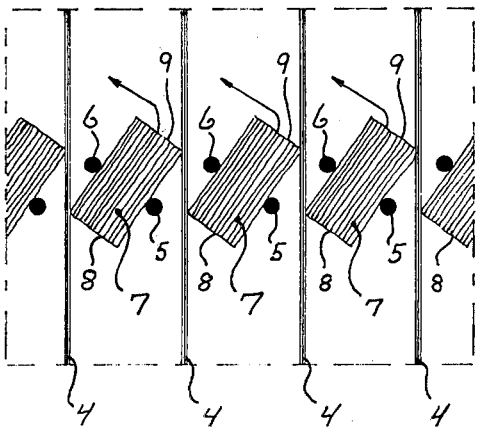

FIG. 4 illustrates how the strips 7 cut from the fibrous layer are carried away from the nip zone by means of the conveying wires 5 and 6. Owing to the arrangement of the paths of each pair of conveying wires 5 and 6 the strips 7 conveyed by the wires start turning about their longitudinal axes immediately after having left the nip zone. In the initial stage of this movement, the strips 7 are separated from one another by means of the knives 4 so that they can be turned about their individual axes without the fibre ends 8 and 9 interfering with each other. Before the strips 7 leave the space between the knives 4, the turning has already proceeded to a point where the fibre ends 8 and 9 of adjacent strips have been physically removed from one another and therefore cannot interfere with each other during the further progress. The arrows in FIG. 4 show the direction of rotation.

Figure 5:
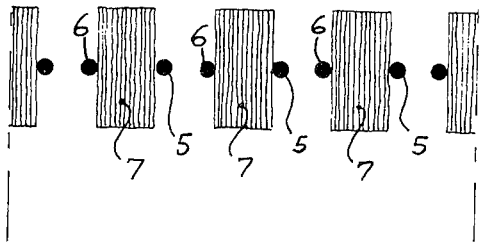

The turning of the strips 7 is caused by the fact that the conveying wires 5 and 6 are located in positions opposite one another on either side of the subdivided batt in the nip zone of the input rollers, but when arriving at the depositing rollers 10 these wires are located side by side in a common place so that with respect to this common plane the individual small fibres, which constitute the strips and are to form the pile fibres of the final product, are now standing on end. Thus, immediately before entering into contact with the depositing roller 10 the fibres have been turned through an angle of practically 90° about an axis in the conveying direction as illustrated in FIG. 5.

Figure 6:
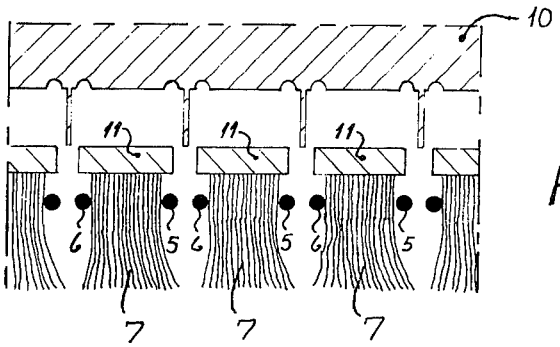

Immediately before entering into contact with the roller 10, the cut fibres 7 are pressed out from between the conveying wires 5 and 6 by means of a guiding surface in the form of a plate 11, see FIG. 6, so that the fibres, which were originally gripped between the conveying wires at their middle, are now gripped at one end. The free fibre ends will now have a natural tendency to start spreading so as to approach the free fibre ends of adjacent strips to one another. The partial pressing out of the fibres facilitates their correct subsequent contact with the roller 10. Instead of the plate 11, a roller or an air nozzle could be used.

Figure 7:
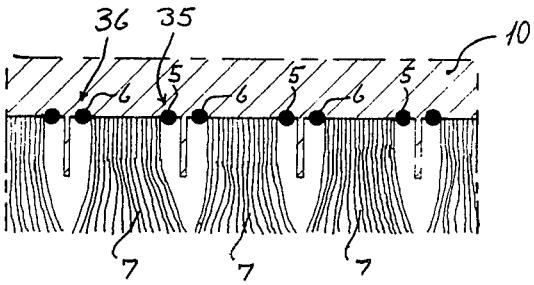
Figure 8:
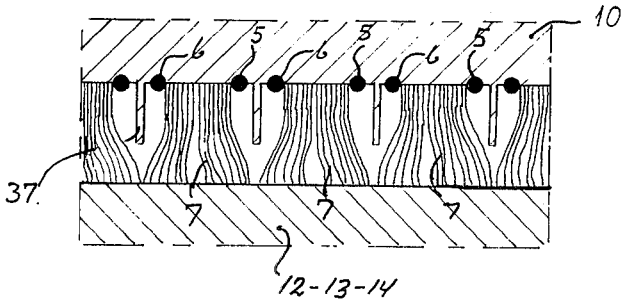

As illustrated in FIG. 7, the depositing roller 10 is constructed with circumferential ribs between the paths of the individual strips 7 so that the fibres 7 are separated and supported at the end adjacent to the conveying wires 5 and 6. As is apparent from FIG. 7, the wire guiding grooves 35 and 36 of the depositing roller 10 have a depth substantially corresponding to the radius of the conveying wires 5 and 6. Consequently, when entering into contact with the depositing roller 10 the strips of fibres 7 are in fact pressed fully out of the space between the wires, but they are nevertheless held in position because of the engagement of the wires with the somewhat fluffy fibre ends. This is enough for preventing the fibres from dropping, but on the other hand the fibres will offer very little resistance to be fully withdrawn from the conveying wires in the subsequent stage where the free fibre ends are applied to the adhesive backing. In the stage reached in FIG. 7, the tendency of the free fibre ends to spread is continued, and this tendency may be promoted by means of rollers 12, 13 and 14, FIG. 8, brushes or similar well known equipment, the height of the ribs 37 being chosen low enough to permit for the provision of such equipment. As a consequence of the spreading of the fibre ends these will gather from strip to strip to form a substantially uniform and homogenous surface pattern. A treatment like that illustrated in FIG. 8 might also be performed already in the stage illustrated in FIG. 6.

Figure 9:
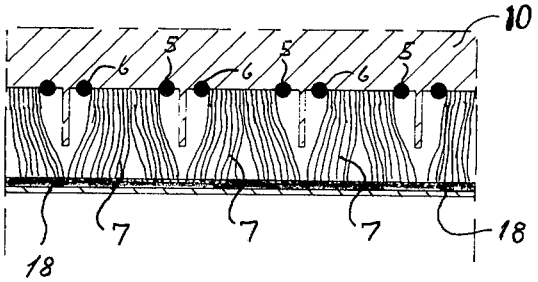
Figure 10:
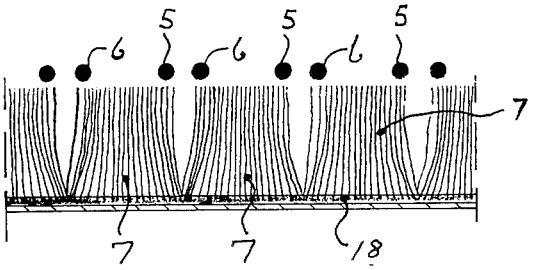
Figure 12:
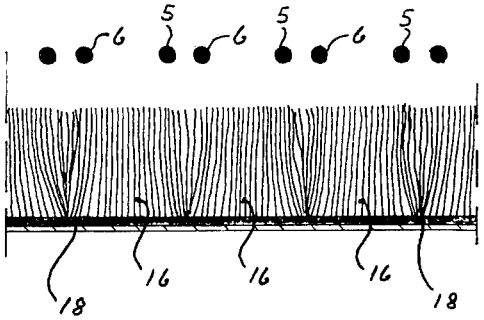

FIG. 9 shows how the fibres 7 are deposited on an adhesive backing 18, which may consist of a viscous layer of a polymeric material adapted to be hardened or cured by continued polymerization which is advanced on a belt conveyor (not shown) and after having received the pile fibres may proceed into a heating channel (not shown) for accelerating the hardening or curing process. It will be realized that in the moment of deposition on the adhesive backing 18, the fibre ends applied to the adhesive layer will have assumed a homogenous pattern spread over the width of the adhesive backing and are anchored in this pattern by adhesion. Thereby the fibres are now fully removed from the conveying wires as illustrated in FIG. 10. As will be seen the paths of the conveying wires 5 and 6 following the depositing zone diverge from the path of the adhesive backing so that the distance between the fibre ends, which are now free, and the conveying wires increases, see FIG. 12.

Figure 11:
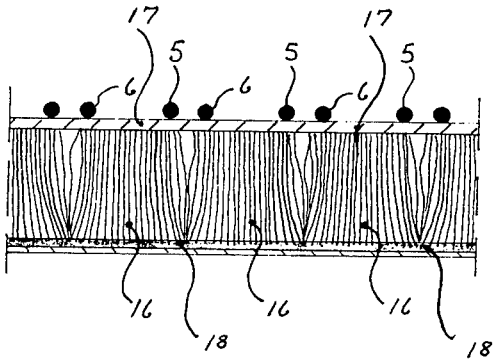
Figure 13:
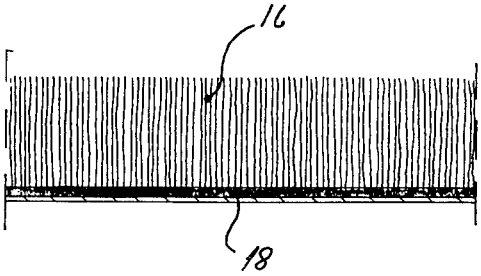

There is, however, a possibility that during the travel along the depositing roller 10, some of the fibres may get into so close contact with the conveying wires 5 and 6 that the adhesion between the conveying wire and the individual fibre may be greater than the adhesion between the backing 18 and the fibre. Therefore, a scraper 17, FIG. 11, is arranged to engage the conveying wires 5 and 6 from below so as to ensure that the fibres remain in the pile surface. The fibre ends which are now free will have a tendency to spread in accordance with the uniform pattern in which the fibres are anchored in the backing 18 so that the free surface of the pile structure will assume a homogenous pattern as illustrated in FIG. 13. The tendency of the fibres to spread in this manner may be promoted by subsequent processes such as heating, mechanical processing or a blast of air before the adhesive backing 18 has proceeded to the stage of hardening.

If desired another adhesive backing may be applied to the free fibre ends whereafter the combined structure may be sliced through the pile to form two carpets having equal or different pile height.

We claim:

1. A process for producing and depositing a fibrous pile comprising the steps of providing a batt having substantially parallel edges defining a longitudinal direction of the batt and consisting of a fibrous material oriented substantially transversely of said longitudinal direction, forwarding said batt in its longitudinal direction, subdividing said batt into strips by cuts longitudinal of the batt and substantially perpendicular to the orientation of the fibres, forwarding each strip in a free path between a pair of conveying wires having line contact only with the strips, so that the fibres of the strips extend freely in both directions from the lines of contact with the conveying wires and running from a position in which they are located in positions opposite one another on either side of the subdivided batt to a position in which they are located side by side in a longitudinal plane of the subdivided batt, thereby turning each strip through an angle of 90° about its longitudinal axis, displacing the strips out of the spaces between said pairs of conveying wires by means acting on the portions of the fibres extending freely in one direction from the lines of contact with the conveying wires, and applying the portions of the fibres extending freely in the other direction from said lines of contact to a moving pile receiving surface.

2. A process as in claim 1, in which the strips are displaced out of the spaces between said pairs of conveying wires by means of a guiding surface against which the fibres extending freely in said first mentioned direction are caused to rest.

3. A process as in claim 2, in which the strips are pressed wholly or practically wholly out of the space between the conveying wires before being deposited on the backing.

4. A process as in claim 2, in which the strips in a zone of their path before reaching the guiding surface are pressed partly out from between the conveying wires.

5. A process as in claim 4, characterized in that in a zone where the strips have been pressed partly out from between the conveying wires, the strips are subjected to a treatment tending to promote the tendency of the fibre ends of adjacent strips to gather in a substantially homogenous surface pattern.

6. A process as in claim 3, in which upon deposition of the fibres on the backing, the conveying wires are moved past a scraper engaging the wires from the side from which the fibres projected immediately before deposition.

7. A process as in claim 1, in which the pile receiving surface is the adhesive surface of a backing and in which the fibres after having been deposited on the backing and before the adhesion of same to the backing has proceeded to the stage of hardening are subjected to a treatment prompting the tendency of fibre ends, remote from the backing, to gather in a substantially homogenous surface pattern.

8. An apparatus for producing and depositing a fibrous pile, comprising a pair of input rollers which by means of opposed grooves in the rollers of the pair is subdivided into a number of sections, means for introducing a batt of fibrous material oriented substantially in the axial direction of said input rollers into a nip zone of said pair of input rollers, cutting means being provided between said sections for cutting the fibre batt introduced between the rollers into strips, viz. one strip for each section, opposed wire guiding grooves for a pair of conveying wires being provided in each section in the circumferential surfaces of two rollers of the pair to engage the respective strip along opposed lines of contact from which the fibres of the strip extend freely in both lateral directions, a depositing roller being provided at a distance from said pair of input rollers, said depositing roller being provided at a distance from said pair of input rollers, said depositing roller having a number of pairs of circumferential guiding grooves corresponding to the number of input rollers, the circumferential guiding grooves of each pair being located side by side with intervening surface portions to act on the portions of the fibres extending freely in one direction from the lines of contact with the conveying wires, thereby to displace the strips out of the spaces between said pairs of conveying wires, each of said pair of conveying wires running in paths from a pair of guiding grooves of the pair of input rollers to a corresponding pair of guiding grooves of the depositing roller and from there onwards across guiding rollers back to the respective input rollers, and means for moving a pile receiving surface past said depositing roller in a path to receive the fibres on end extending freely in the other direction from said lines of contact.

9. An apparatus as in claim 8, in which the conveying wires run in straight paths under tension from the input rollers to the depositing roller.

10. An apparatus as in claim 8, in which the cutting means consist of knives rotating about an axis outside the contour of the input rollers and extending into the grooves between the sections of the input rollers.

11. An apparatus according to claim 10, in which the cutting edges of the rotating knives substantially pass through the nip zone of the pair of input rollers.

12. An apparatus as in claim 8, in which the return runs of the conveying wires to one of the input rollers extend through the spaces between adjacent pairs of conveying wires in a point of the path of the latter between the input rollers and the depositing roller where the turning of the strips has proceeded to an advanced stage.

13. An apparatus as in claim 8, characterized in that in a zone of the path of the conveying wires immediately ahead of the depositing roller guiding means are provided behind the conveying wires for partly pressing the strips out between the pairs of conveying wires.

14. An apparatus as in claim 8, in which the wire guiding grooves of the depositing roller have a depth substantially corresponding to the radius of the conveying wires.

15. An apparatus as in claim 8, characterized in that the depositing roller is provided with circumferential ribs between the paths of the individual strips.

16. An apparatus as in claim 8, characterized in that the paths of the conveying wires following the depositing zone extend in paths deverging from the path of the pile receiving surface, said paths running to a guiding roller common to all of the conveying wires.

17. An apparatus as in claim 16, in which a scraper is provided to engage the conveying wires at a point of the path defined in claim 16, said scraper engaging the wires from the side facing the backing.

* * * * *

UNITED STATES PATENT OFFICE

CERTIFICATE OF CORRECTION

PATENT NO. : 4,017,345

DATED : April 12, 1977

INVENTOR(S) : Esben Bruhn and Finn Hansen Jensen

It is certified that error appears in the above-identified patent and that said Letters Patent are hereby corrected as shown below:

Column 6, line 30, after "number" insert

-- of sections of the pair --

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*